US011083280B2

(12) United States Patent
Steiner

(10) Patent No.: US 11,083,280 B2
(45) Date of Patent: Aug. 10, 2021

(54) EXTENDING FLEXIBLE BRISTLE TOOTHBRUSH

(71) Applicant: Josef Dion Fraraccio, Garfield, NJ (US)

(72) Inventor: Katherine Grace Steiner, Maywood, NJ (US)

(73) Assignee: Josef Dion Fraraccio, Garfield, NJ (US)

( * ) Notice: Subject to any disclaimer, the term of this patent is extended or adjusted under 35 U.S.C. 154(b) by 122 days.

(21) Appl. No.: 16/278,068

(22) Filed: Feb. 16, 2019

(65) Prior Publication Data

US 2020/0260858 A1 Aug. 20, 2020

(51) Int. Cl.

| | |
|---|---|
| ***A46B 9/00*** | (2006.01) |
| ***A46B 9/10*** | (2006.01) |
| ***A46B 7/06*** | (2006.01) |
| ***A46B 9/04*** | (2006.01) |
| ***A46B 9/02*** | (2006.01) |

(52) U.S. Cl.

CPC ..... *A46B 9/10* (2013.01); *A46B 7/06* (2013.01); *A46B 9/026* (2013.01); *A46B 9/04* (2013.01); *A46B 2200/1066* (2013.01)

(58) Field of Classification Search

CPC .. A46B 9/10; A46B 7/06; A46B 9/026; A46B 9/04; A46B 2200/1066

See application file for complete search history.

(56) References Cited

U.S. PATENT DOCUMENTS

| | | | | |
|---|---|---|---|---|
| 2,111,880 A * | 3/1938 | Waters | A46B 7/02 | 15/176.6 |
| 2,429,437 A * | 10/1947 | Walker | A46B 7/02 | 15/172 |
| 4,403,623 A * | 9/1983 | Mark | A46B 7/02 | 15/167.1 |
| 6,357,073 B1 * | 3/2002 | Yue | A46B 5/0075 | 15/167.1 |
| 7,578,022 B1 * | 8/2009 | Schraga | A46B 9/10 | 15/167.1 |
| 8,499,402 B1 * | 8/2013 | Arsenault | A46B 5/0079 | 15/167.1 |

* cited by examiner

*Primary Examiner* — Steven O Douglas
(74) *Attorney, Agent, or Firm* — Lando & Anastasi, LLP

(57) ABSTRACT

A toothbrush is provided. The toothbrush includes a handle, a bristle containing component coupled to a first end of the handle, and an actuation mechanism connected to the bristle containing component. The actuation mechanism includes an actuator lever fixedly secured to a periphery of the flexible membrane and an actuator switch coupled to an end of the actuator lever. configured, upon actuation, to allow the actuator lever to translate and deform the flexible membrane along the length of the handle. The actuator lever is configured, upon actuation, to allow the actuator lever to translate and deform the flexible membrane along the length of the handle.

6 Claims, 4 Drawing Sheets

EXTENDING FLEXIBLE BRISTLE TOOTHBRUSH

SUMMARY

In accordance with an aspect, there is provided a toothbrush. The toothbrush may comprise a handle comprising a first end and second end, a bristle containing component operatively coupled to the first end of the handle and comprising a flexible membrane having a first end fixedly secured to the handle, and an actuation mechanism. The bristle containing component may be configured to be deformable along a length of the handle defined by the first end and the second end of the handle. The actuation mechanism may comprise an actuator lever having a first end fixedly secured to a second end of the flexible membrane and an actuator switch coupled to an end of the actuator lever. The actuator switch may be configured to, upon actuation, allow the actuator lever to translate and deform the flexible membrane along the length of the handle defined by the first end and the second end of the handle.

In some embodiments, the actuator gear and actuator lever are disposed within the handle.

In some embodiments, the actuator lever is fixedly secured to a point on a periphery of the flexible membrane. For example, the first end of the actuator lever is fixedly secured to a point on the periphery of the second end of the flexible membrane closest to the actuator switch. In some embodiments, the first end of the actuator lever is fixedly secured to a point on the periphery of the second end of the flexible membrane closest to the first end of the handle.

In some embodiments, the flexible membrane may be constructed and arranged to form an arc when deformed upon actuation of the actuator switch.

In some embodiments, the actuator switch translates along a length of the handle.

In some embodiments, the bristle containing component is constructed and arranged to be removable from the first end of the handle.

BRIEF DESCRIPTION OF THE DRAWINGS

The accompanying drawings are not drawn to scale. In the drawings, each identical or nearly identical component that is illustrated in the various figures is represented by a like numeral. For purposes of clarity, not every component may be labeled in every drawing. In the drawings.

DETAILED DESCRIPTION

Most toothbrush designs have a flat or slightly curved bristle component. The interior of a person's mouth is shaped differently than most traditional toothbrush designs.

For example, the mouth is a curved or oval shape whereas most toothbrushes are flat with the bristles connected to one end of narrow width handle, either straight or at a small angle. Thus, there is a need for improved designs for toothbrushes to allow for more effective cleaning of teeth. An example of how a toothbrush with a flexible bristle base described herein can change the way individuals brush their teeth is when attempting to brush the back of the back teeth, e.g., molars. A flexible bristle base toothbrush design may allow for the bristle component to flex above the handle to better contour to the molars to allow the bristles to better reach behind the back and sides of the molars.

In accordance with at least one aspect described herein, there is provided a toothbrush. The toothbrush may include a handle comprising a first end and second end, a bristle containing component operatively coupled to the first end of the handle and comprising a flexible membrane having a first end fixedly secured to the handle, and an actuation mechanism. The bristle containing component may be configured to be deformable along a length of the handle defined by the first end and the second end of the handle. The actuation mechanism may comprise an actuator lever having a first end fixedly secured to a second end of the flexible membrane and an actuator switch coupled to a second end of the actuator lever. The actuator switch may be configured, upon actuation, to allow the actuator lever to translate and deform the flexible membrane along the length of the handle defined by the first end and the second end of the handle.

Figure 1:
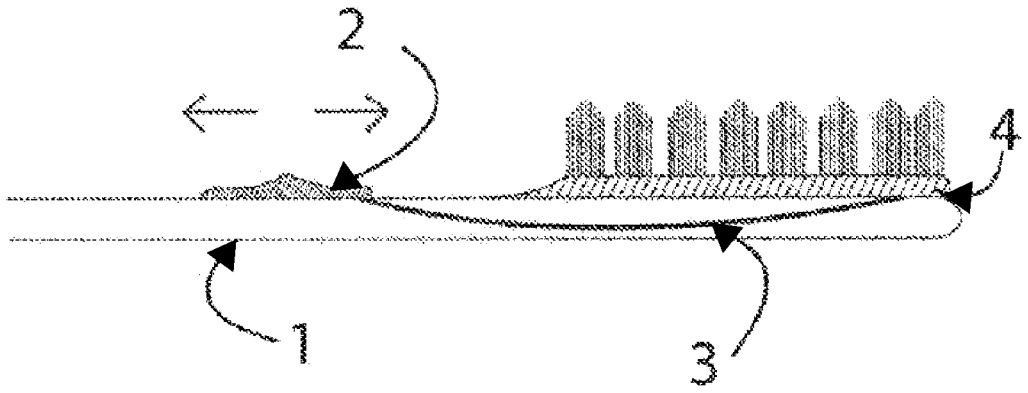
FIG. 1 illustrates a side view of a toothbrush with a bristle containing component comprising a flexible membrane, according to one embodiment.

An embodiment of a toothbrush of this disclosure is illustrated in FIG. 1. With reference to FIG. 1, the toothbrush includes handle 1, actuator switch 2, actuator lever 3, and bristle containing component 4 operatively coupled to the first end of the handle 1. The arrows above the actuator switch 2 indicate the travel of the actuator switch 2 along a length of toothbrush handle 1. When actuator switch 2 is actuated along the toothbrush handle 1, the actuator lever 3 translates to allow bristle containing component 4 to deform. As illustrated, the actuator switch 2, actuator lever 3, and bristle containing component 4 are in a neutral, rest, or normal position without the actuator switch 2 being engaged.

In the illustrated embodiment of FIG. 1, the actuation mechanism including the actuator switch 2 and actuator lever 3 are constructed and arranged such that the actuator lever 3 is disposed within the handle 1. In this configuration, the actuator switch 2 may travel along a recess, groove, or channel formed into the handle. In some embodiments, the actuation mechanism may be external to the handle 1, or may have some components external to and some components disposed within the handle 1. Further, the actuation mechanism illustrated is exemplary and is not intended to be limiting. This disclosure envisions other actuation mechanisms without departing from the scope and spirit of this disclosure.

Figure 2:
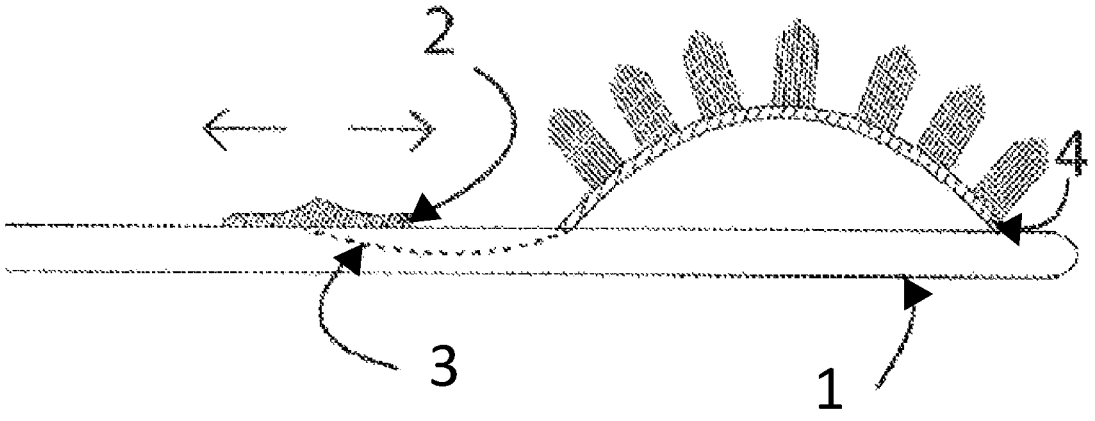
FIG. 2 illustrates the toothbrush of FIG. 1 with the flexible membrane of the bristle containing component deformed, according to one embodiment.

An embodiment of a toothbrush of this disclosure with the bristle containing component 4 deformed, e.g., such that it forms an arc above handle 1, is illustrated in FIG. 2. With reference to FIG. 2, and using the same numbering convention as FIG. 1, actuation of the actuator switch 2 allows actuator lever 3 to translate within the handle 1, thus deforming the bristle containing component 4 along the length of the handle 1 defined by the first end and the second end of the handle 1. In the illustrated configuration, the first end of flexible membrane of the bristle containing component 4 is fixedly secured to the handle 1 and the second end of the flexible membrane of the bristle containing component 4 is fixedly secured to an end of the actuator lever 3. In this configuration, when the actuator switch 2 is engaged along the arrows indicated in the figure, the actuator lever 3 translates to allow the bristle containing component 4 to deform along the length of the handle defined by the first end and the second end of the handle. The deformation of the bristle containing component 4 forms an arc, e.g., a semi-circle, semi-oval, or half-circle, due to the fixed connection between the handle 1 and bristle containing component 4 and the movable connection between the bristle containing component 4 and the actuator lever 3. One of skill in the art can appreciate that the curvature of the arc formed by the deformation of the flexible membrane of the bristle containing component 4 may be adjusted by the position of the actuator lever controlled by the engagement of the actuator switch 2 and where the actuator lever 3 is fixedly secured to the flexible membrane of the bristle containing component 4.

Figure 3:
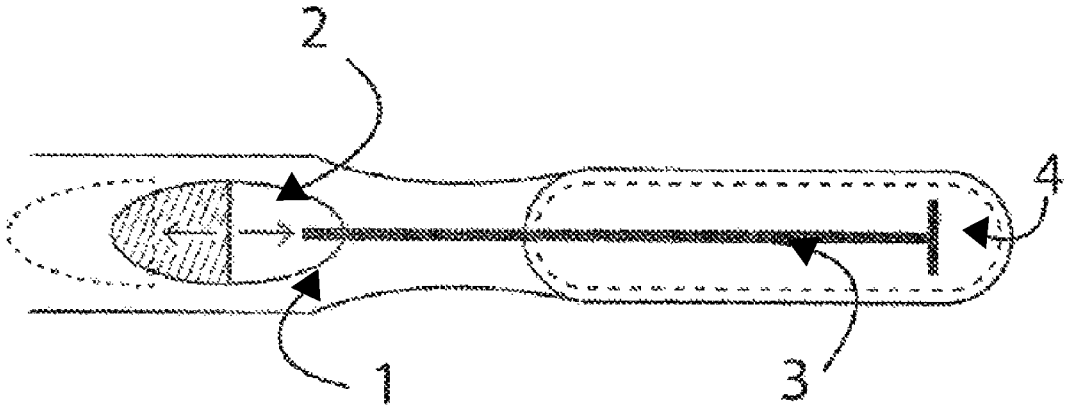
FIG. 3 illustrates a toothbrush having an actuator lever fixedly connected to the flexible membrane of the bristle containing component furthest from the actuator switch, according to one embodiment.

In some embodiments, the first end of the actuator lever 3 may be fixedly connected to a point on a periphery of the second end of the flexible membrane of the bristle containing component 4 at a position closest to a tip of the first end of the handle 1. An embodiment of a toothbrush with this configuration is illustrated in FIG. 3. With reference to FIG. 3, and using the same numbering scheme as FIGS. 1 and 2, the actuation lever 3 is fixedly connected the periphery of the flexible membrane of the bristle containing component 4 at a position furthest from the actuation switch 3. In this configuration, when actuation switch 2 is translated along the handle 1 in the direction of the arrows shown, the flexible membrane of the bristle containing component 4 deforms along the length of the handle defined by the first end and the second end of the handle. Without wishing to be bound by any particular theory, the amount of deformation, and thus the radius of curvature of the arc formed in the flexible membrane of the bristle containing component 4, is a function of the length of travel of the actuator lever 3, further in part determined by a length of the actuator lever 3. Thus, in the embodiment illustrated in FIG. 3, the flexible membrane of the bristle containing component 4 travels furthest and forms an approximate half circle arc (not shown) when the actuation switch 2 is engaged.

Figure 4:
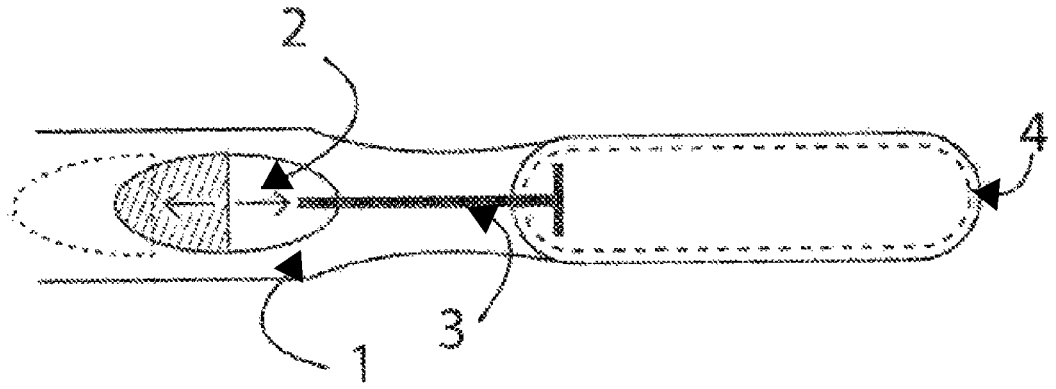
FIG. 4 illustrates a toothbrush having an actuator lever fixedly connected to the flexible membrane of the bristle containing component closest to the actuator switch, according to one embodiment.

In some embodiments, the first end of the actuator lever 3 may be fixedly connected to a point on a periphery of the second end of the flexible membrane of the bristle containing component 4 at a position closest to the actuator switch 2. An embodiment of a toothbrush with this configuration is illustrated in FIG. 4. As described herein the length of travel of the actuator lever may determine the amount of deformation of the flexible membrane of the bristle containing component 4. In the illustrated configuration, when actuation switch 2 is translated along the handle 1 in the direction of the arrows shown, the reduced length of the actuator lever 3, and thus the reduced length of travel, deforms the flexible membrane of the bristle containing component 4 less than the embodiment illustrated in FIG. 3. Thus, in the embodiment illustrated in FIG. 3, the flexible membrane of the bristle containing component 4 travels the shortest distance and forms an approximate semi-oval arc (not shown) when the actuation switch 2 is engaged.

In some embodiments, and as illustrated in FIGS. 1-4, the bristle containing component 4 includes a plurality of bristles connected thereto. The bristles may be constructed of a flexible material to allow for conforming to the naturally curved shape of the interior of the mouth and individual teeth when in use. One of skill in the art can appreciate the characteristics of the bristles may be adapted to individual needs of the user. For example, the plurality of bristles in the bristle containing component 4 may have varying lengths, widths, profiles, hardness, colors, for different oral conditions or dental cleaning requirements. The invention of this disclosure is not limited in the characteristics of the plurality of bristles within the bristle containing component 4.

In further embodiments, the bristle containing component 4 may be configured to be a replaceable component. The bristle containing component 4 may include a structural element, such as a detent, clip, button, or the like, which allows the bristle containing component 4 to be removed from the handle 1 if needing replacement or to change from one type of bristle to another. The invention of this disclosure is in no way limited by the mechanism used to connect and/or release a bristle containing component 4 from the handle 1.

Having thus described several aspects of at least one embodiment, it is to be appreciated various alterations, modifications, and improvements will readily occur to those skilled in the art. Any feature described in any embodiment may be included in or substituted for any feature of any other embodiment. Such alterations, modifications, and improvements are intended to be part of this disclosure and are intended to be within the scope of the invention. Accordingly, the foregoing description and drawings are by way of example only.

Those skilled in the art should appreciate that the parameters and configurations described herein are exemplary and that actual parameters and/or configurations will depend on the specific application in which the disclosed methods and materials are used. Those skilled in the art should also recognize or be able to ascertain, using no more than routine experimentation, equivalents to the specific embodiments disclosed.

The invention claimed is:

1. A toothbrush, comprising:

a handle comprising a first end and second end;

a bristle containing component operatively coupled to the first end of the handle, the bristle containing component comprising a flexible membrane having a first end fixedly secured to the handle, the bristle containing component configured to be deformable along a length of the handle defined by the first end and the second end of the handle; and an actuation mechanism comprising:

an actuator lever having a first end fixedly secured to a second end of the flexible membrane; and an actuator switch coupled to a second end of the actuator lever and configured, upon actuation, to allow the actuator lever to translate and deform the flexible membrane along the length of the handle defined by the first end and the second end of the handle, wherein the flexible membrane is constructed and arranged to form an arc when deformed upon actuation of the actuator switch.

2. The toothbrush of claim 1, wherein the actuator lever is disposed within the handle.

3. The toothbrush of claim 1, wherein the first end of the actuator lever is fixedly secured to a point on the periphery of the second end of the flexible membrane closest to the actuator switch.

4. The toothbrush of claim 1, wherein the first end of the actuator lever is fixedly secured to a point on the periphery of the second end of the flexible membrane closest to the first end of the handle.

5. The toothbrush of claim 1, wherein the actuator switch is configured to translate along a length of the handle defined by the first end and the second end of the handle.

6. The toothbrush of claim 1, wherein the bristle containing component is constructed and arranged to be removable from the first end of the handle.

* * * * *